United States Patent [19]

League, IV

[11] Patent Number: 4,520,297

[45] Date of Patent: May 28, 1985

[54] SOLIDIFIED CHARGE PROTECTION CONTROL FOR ROTATING APPARATUS

[75] Inventor: John S. League, IV, Baltimore, Md.

[73] Assignee: Mineral Processing Systems, Inc., York, Pa.

[21] Appl. No.: 414,632

[22] Filed: Sep. 3, 1982

[51] Int. Cl.[3] ..... F27B 7/00

[52] U.S. Cl. ..... 318/490; 366/601; 366/233; 241/26

[58] Field of Search ..... 318/490; 366/601, 233; 241/26

[56] References Cited

U.S. PATENT DOCUMENTS 4,030,878 6/1977 Kunath ..... 318/490 X 4,123,009 10/1978 Kilpinen ..... 318/490 X

*Primary Examiner*—William M. Shoop

*Assistant Examiner*—Saul M. Bergmann

*Attorney, Agent, or Firm*—Charles J. Long

[57] ABSTRACT

Disclosed is a solidified charge protection control for rotating grinding mills. A charged mill which has been shut down for a period of time is rotated to a pre-set angle of rotation and a bi-directional sensor feeds the signal caused by rotation to an electronic circuit where it is analyzed. Once the mill has reached the pre-set angle of rotation, it is declutched and the sensor feeds a second signal to the electronic circuit. These signals are compared to pre-set limits to determine if the charge has broken-up during the initial rotation so continuous operation of the mill can be commenced.

4 Claims, 2 Drawing Figures

SOLIDIFIED CHARGE PROTECTION CONTROL FOR ROTATING APPARATUS

FIELD OF THE INVENTION

This invention relates to an electronic control for starting rotating apparatus and, more particularly, to a control to determine if a charge in a rotating grinding mill remains solidified after the mill has been rotated a pre-set amount during start-up.

DESCRIPTION OF THE PRIOR ART

Often times, a mill containing a charge and water slurry combination will have to be stopped for one reason or another. If the shut down extends for a prolonged period of time, the charge which had come to rest in the lowest level of the mill solidifies. When the mill is restarted the charge could remain solidified as the mill turns and when it reaches a certain height fall as un unbroken mass causing damage to the liners, mill shell and even the mill bearings. To prevent such damage from a solidified dropped charge, mill operators, when they restart the mill, will first "jog" it to loosen the charge by rotating it a certain number of degrees and then declutching the mill drive to allow it to turn freely back to its starting position, after which they restart the mill for continuous operation. While this prior art method has often worked to prevent damage to the mill from a dropped charge, it depends to a great extent on the skill of the particular operator jogging the mill and the conditions under which he is working. For example, the pressures to resume production or a distraction occurring while he is jogging the mill could cause the operator to incorrectly assume that the charge is loosened and restart the mill for continuous operation when, in fact, the charge had remained solidified. Such occurences have not been remote in the mineral processing industry.

SUMMARY OF THE INVENTION

The present invention overcomes the problems of the prior art by providing an electronic method and apparatus to measure the mill rest position to determine if the charge therein has broken loose. The present invention counts the number of gear teeth passing a bi-directional pick-up during the initial rotation of the mill and during oscillation of the mill. The signals generated by the gear teeth passing the pick-up are counted and compared to pre-set limits to determine if the oscillation pattern and the final rest position of the mill indicates the charge is loose. If so the mill is started for continous operation; if not, the mill is once again rotated to the pre-set angle only and declutched again.

DESCRIPTION OF THE PREFERRED EMBODIMENT

Figure 1:
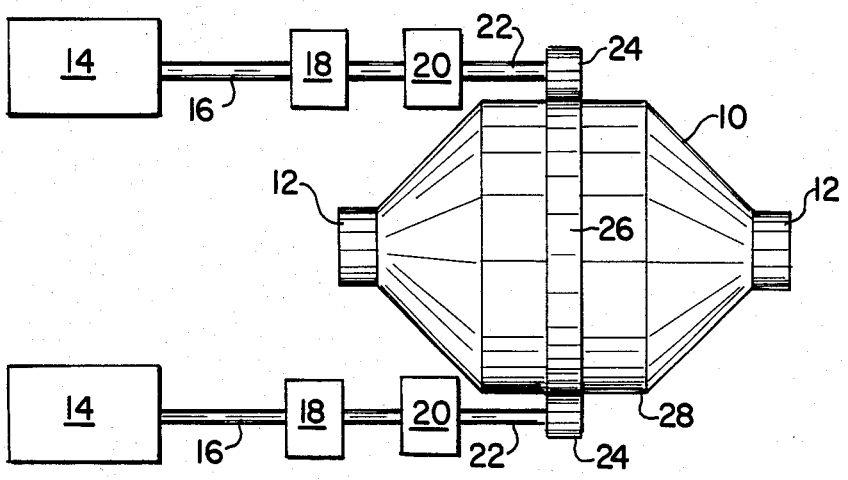
FIG. 1 is a diagramtic plan view of a grinding mill employing the method and apparatus of the present invention.

Referring to FIG. 1, the primary mill 10 is supported for rotation in bearings 12. The driving means for mill 10 is conventional and includes electric motors 14, shafts 16, gear boxes 18, clutches 20, drive shafts 22 and driving gears 24. Driving gears 24, mounted on shafts

22 in a conventional manner, operably engage ring gear 26 and rotate mill 10 through such operable engagement. Ring gear 26 is fixed to the outside circumference of the shell 28 of mill 10. A friable material, which is the usual charge, and water are introduced into mill 10 in a conventional manner. It is the charge and water slurry combination which can become solidified in the mill if rotation of the mill is interrupted.

Figure 2:
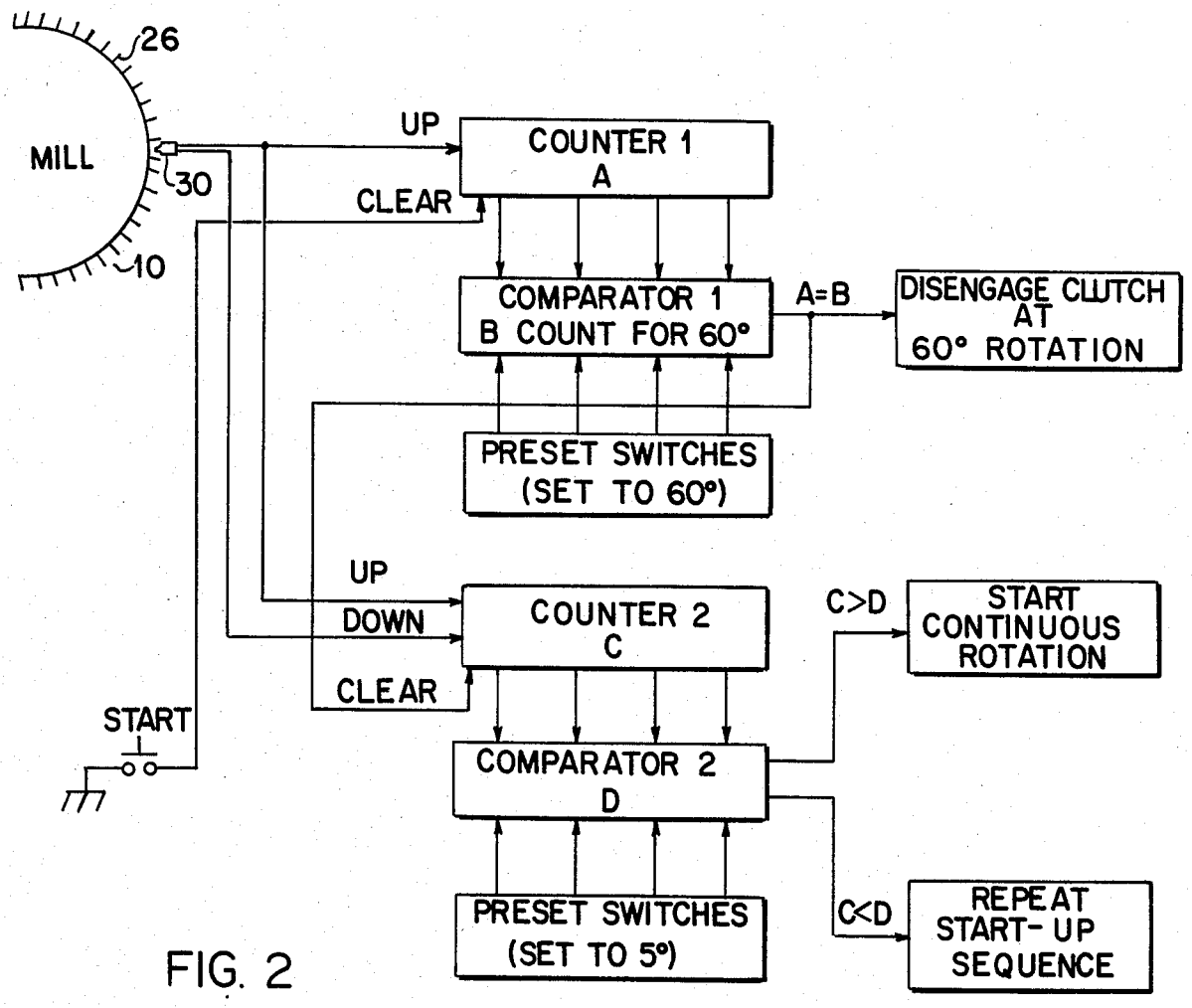
FIG. 2 is the block diagram of the circuit of the present invention.

Referring now to FIG. 2, a bi-directional pick-up 30 is mounted by conventional means to ring gear 26 of mill 10. The passage of the teeth of gear 26 in either direction causes pick-up 30 to generate a signal which is fed to an electronic counter circuit including Counters 1 and 2 and Comparators 1 and 2. Comparators 1 and 2 are each pre-set to a predetermined count by conventional selector switches. Comparator 1 is set to indicate an increment of mill rotation; for example, if ring gear 26 has 360 teeth the setting for Comparator 1 could be 60 counts, representing 60° of rotation. If the ring gear is of different design the counts are adjusted proportionally to set for the desired incremental rotation. Of course, the setting of Comparator 1 can be adjusted to allow for greater or less rotation depending on charge characteristics. Likewise, Comparator 2 is pre-set to a count indicating a smaller increment of rotation, for example 5°.

When the mill is restarted, pick-up 30 generates a step count for each tooth passing the pick-up. This step count is fed as an input to both Counter 1, configured to count up only, and Counter 2, configured to count both up and down. When the count in Counter 1, designated A, equals the pre-set count in Comparator 1, designated B, the mill is automatically declutched by a conventional circuit. The mill then oscillates freely to a rest position; during oscillation Counter 2 continues to count up for rotation in one direction and down for rotation in the other direction. The final count in Counter 2, designated C, is compared to the pre-set count in Comparator 2, designated D. If C is greater than D, which indicates a shift in the mass moment of inertia of the mill and its charge, the circuit causes the mill to be restarted for continuous operation. If C is less than D, which indicates the contained charge has not broken loose, the circuit automatically repeats the start-up sequence again until C is greater than D.

While I have described a certain preferred embodiment of my invention, it will be understood that it may be otherwise embodied within the scope of the following claims.

What is claimed:

1. An electrical control apparatus for determining if a charge has solidified in a rotating apparatus comprising:

(a) means for sensing the angular position of the rotating apparatus;

(b) means for sensing an initial rest position of the rotating apparatus;

(c) means for rotating said apparatus a pre-set amount;

(d) means to cause said apparatus to oscillate in a free manner;

(e) means to evaluate the oscillation and sense a final rest position of said apparatus; and (f) means to restart the rotation of said apparatus if said final rest position is moved from said initial rest position by more than a pre-set angular amount.

2. The control apparatus of claim 1 wherein said means for rotating said rotating apparatus said pre-set amount comprises an electronic counter circuit.

3. A control apparatus for determining if a charge has solidified in a rotating apparatus comprising:

(a) means for detecting the amount of rotation of said apparatus;

(b) circuit means for feeding a signal generated by said detecting means to an electronic circuit;

(c) counting and comparator means to determine when said apparatus has rotated a predetermined amount;

(d) electric circuit means to generate a signal to allow said rotating apparatus to oscillate freely when said predetermined amount of rotation has been reached;

(e) counter and comparator means to evaluate said oscillation; and (f) circuit means to restart the rotation of said apparatus.

4. A method to determine if the charge in a rotating apparatus has solidified comprising the steps of:

(a) rotating said apparatus a predetermined amount;

(b) allowing said apparatus to oscillate freely; and (c) evaluating the oscillating and final rest position of said apparatus.

* * * * *